US005802643A

United States Patent [19]

Sloot

[11] Patent Number: 5,802,643

[45] Date of Patent: Sep. 8, 1998

[54] SLIPCOVER WITH AN INFLATABLE PILLOW

[75] Inventor: Alexander Sloot, Sugarloaf, Pa.

[73] Assignee: Printmark Industries, Inc., Hazleton, Pa.

[21] Appl. No.: 745,328

[22] Filed: Nov. 8, 1996

[51] Int. Cl.[6] ..... A47C 20/02

[52] U.S. Cl. ..... 5/656; 5/485; 5/419; 297/220

[58] Field of Search ..... 5/485, 417, 419, 5/656, 639, 644, 636; 297/220, 219, 229, 391, 397

[56] References Cited

U.S. PATENT DOCUMENTS

| | | | |
|---|---|---|---|
| 2,883,682 | 4/1959 | Kwake . | |
| 3,176,315 | 4/1965 | Freund | 5/419 |
| 3,689,947 | 9/1972 | Wolf . | |
| 3,777,310 | 12/1973 | Yang . | |
| 4,097,944 | 7/1978 | Yulish . | |
| 4,200,942 | 5/1980 | Case . | |
| 4,226,902 | 10/1980 | Webb . | |
| 4,370,755 | 2/1983 | Crumby . | |
| 4,553,785 | 11/1985 | Duke | 297/229 |
| 4,725,094 | 2/1988 | Greer | 297/220 |
| 4,877,288 | 10/1989 | Lee | 297/220 |
| 5,079,778 | 1/1992 | Sloot . | |
| 5,251,337 | 10/1993 | Sloot . | |

*Primary Examiner*—Flemming Saether
*Attorney, Agent, or Firm*—St. Onge Steward Johnston & Reens LLC

[57] ABSTRACT

A slipcover with inflatable pillow is provided for furniture comprising a first sheet having an outer layer of fabric attached to an inner layer of thermoplastic, a second, smaller sheet attached to the inner layer of the first sheet so as to form an inflatable pillow, a valve located in at least one of the sheets so as to enable the pillow to be inflated, and a backing layer attached to the first sheet along an edge so as to create a pocket-shaped slipcover with the inflatable pillow in the interior of the slipcover whereby the slipcover can receive a portion of the furniture.

14 Claims, 4 Drawing Sheets

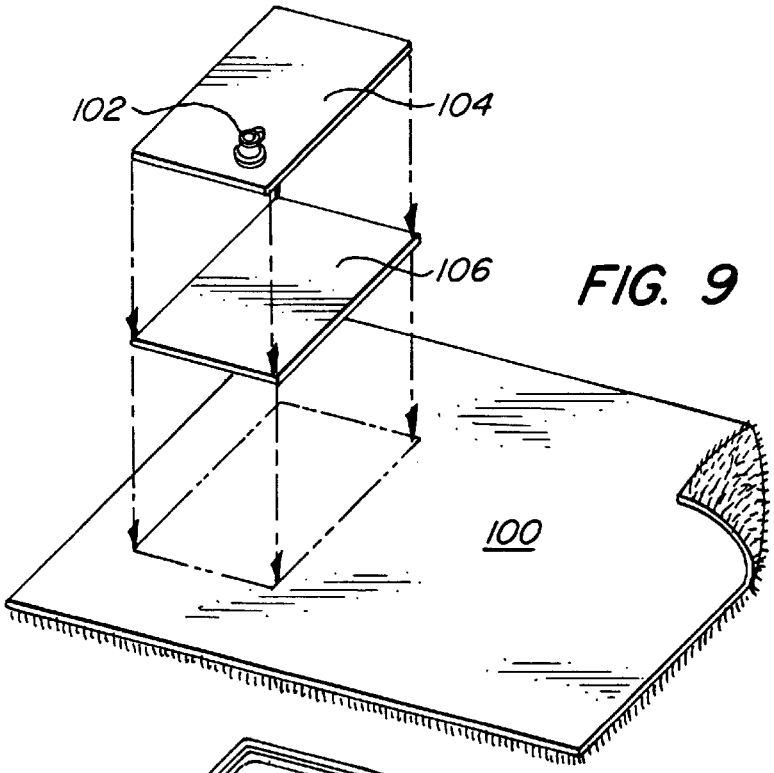
FIG. 9
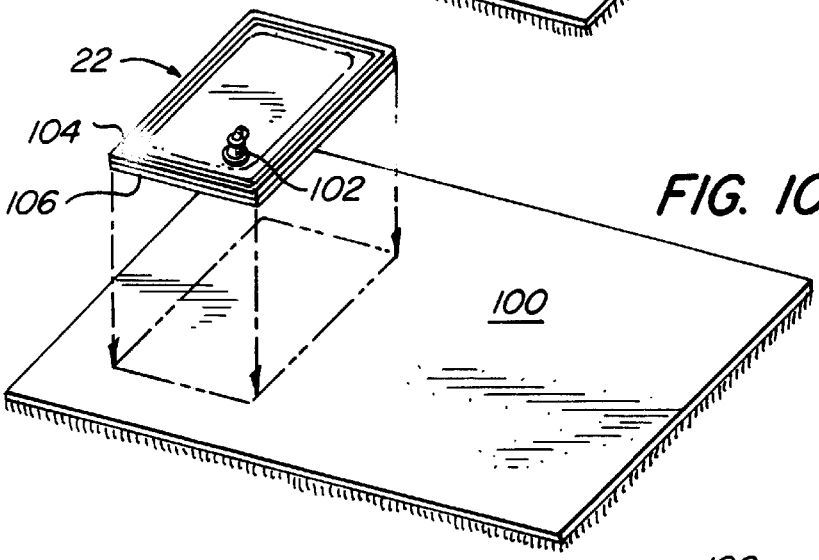
FIG. 10
FIG. 11
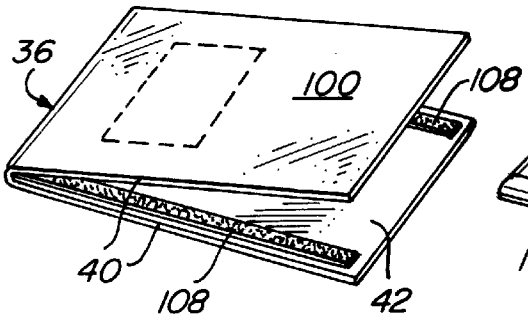
FIG. 12
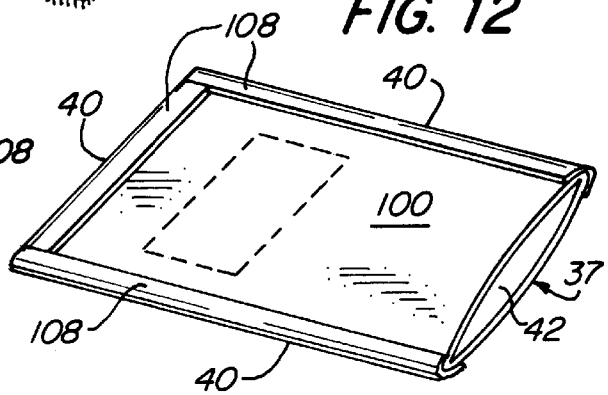

SLIPCOVER WITH AN INFLATABLE PILLOW

FIELD OF THE INVENTION

The invention relates to an inflatable pillow which is used in conjunction with furniture, and more specifically with outdoor furniture.

BACKGROUND OF THE INVENTION

Inflatable appliques for creating unique articles are known in the art and include a variety of features for converting articles such as towels, shirts, coats, and displays into uniquely configured articles with novel shapes and uses.

There are several U.S. patents which teach the attachment or addition of a pillow to a towel for use in, for example, sunbathing. U.S. Pat. No. 4,097,944 (Yulish) discloses a stuffed pillow which is permanently formed in the top portion of a towel. U.S. Pat. No. 4,200,942 (Case) and U.S. Pat. No. 3,689,947 (Wolf) teach a towel with a removable pillow which is either inflatable or stuffed. U.S. Pat. No. 2,883,682 (Kwake) teaches an inflatable pillow which is attachable and detachable from a towel using snapping means.

U.S. Pat. No. 3,176,315 (Freund) discloses a beach robe which doubles as a towel with an inflatable pillow. The article taught by Freund fails to teach a means for holding the pillow in place on a piece of furniture when the article is used in its towel configuration.

U.S. Pat No. 4,370,755 (Crumby) discloses a poncho which has a rear panel which can be inflated to create a seat cushion for sitting. Crumby fails to teach an inflatable pillow for the head for use on a piece of furniture which is held in place even when not in use.

I have previously obtained two U.S. Pat. Nos. 5,079,778 & 5,251,337 for inflatable appliques for clothing and towels and a method for producing those appliques. Those patents describe the production of an inflatable applique on material by sealing the pieces of the applique to the material and cutting away the excess. Because many of the techniques and materials described in those patents are also useful in conjunction with the teachings herein disclosed, they are incorporated by reference.

What is desired, therefore, is a pillow which retains its position on a piece of furniture even when not engaged by someone sitting on the furniture. Preferably, the pillow could be used with outdoor chairs or lounges and would be cheaply produced, portable and waterproof, yet comfortable for the user.

SUMMARY OF THE INVENTION

Accordingly, it is an object of the invention to provide a slipcover for furniture that incorporates an inflatable pillow so that the pillow retains its position on a piece of furniture even when not in use.

Still another object of the invention is to provide a slipcover for furniture that contains an inflatable pillow and is relatively easily and inexpensively manufactured.

These and other objects are achieved by a first embodiment in accordance with the invention in which a slipcover is formed from a first sheet having an outer fabric layer that is attached to an inner thermoplastic layer. A second, smaller sheet is attached to the inner thermoplastic layer of the first sheet, and is fitted with a valve so as to form an inflatable pillow. The valve may also be located so that it pierces the first sheet so as to enable inflation outside the slipcover. A backing layer is attached to the first sheet to create a pocket-shaped slipcover inside of which is the inflatable pillow. The backing layer can be an extension of the first sheet which is folded over so that the inner thermoplastic layer overlaps itself, and the inflatable pillow, and is attached at opposing edges to form the pocket shape of the slipcover. Alternatively, a separate backing layer can be attached to cover the inflatable pillow and form the slipcover. The slipcover can then be slipped over a portion of a piece of furniture, such as the back of an arm chair, and thus, hold the inflatable pillow in place whether or not a person occupies the furniture.

Preferably, the outer fabric layer is made from a soft, water-absorbing material like terry cloth affixed to an inner thermoplastic layer made from vinyl. The outer fabric provides comfort to the user, since the user's head will not be in direct physical contact with the vinyl layer of the inflatable pillow, and further enables fast, economic processing.

Also preferably, when polymeric materials are used for the appropriate pieces, the process employed to attach the different components is either radio frequency (RF) sealing or sonic sealing. These methods both allow fast processing times and form strong, air impenetrable seals required for the inflatable pillow.

In a second embodiment, the slipcover with inflatable pillow can be formed by attaching an entirely fabric slipcover to a vinyl material inflatable pillow. The fabric is preferably either a cloth material such as T-shirting or terry cloth or a spunbonded polyolefin such as Tyvek™. This provides additional options for processing, starting materials, and final look of the slipcover with inflatable pillow.

In another aspect of the invention, the slipcover with its inflatable pillow is transformed into a tote bag. This is achieved by folding the slipcover and pillow to bisect the pillow and adding holes positioned so that when the slipcover is folded they align to create a handle at the open end of the slipcover.

These and other objects and advantages of the invention will become apparent from the following detailed description considered with reference to the accompanying drawings.

BRIEF DESCRIPTION OF THE DRAWINGS

FIG. 9 is an exploded front isometric view of the different components of a second embodiment of a slipcover with an inflatable pillow in accordance with this invention.

FIG. 10 is an exploded front isometric view of an alternative method for forming the slipcover with the inflatable pillow of FIG. 9.

FIG. 11 is a front isometric view of a slipcover, with an inflatable pillow inside (indicated by ghost lines), to illustrate an optional method for forming the slipcover of FIG. 9.

FIG. 12 is a front isometric view of a slipcover, with an inflatable pillow inside (indicated by ghost lines), to illustrate a second optional method for forming the slipcover of FIG. 9.

DETAILED DESCRIPTION OF THE INVENTION

Figure 1:
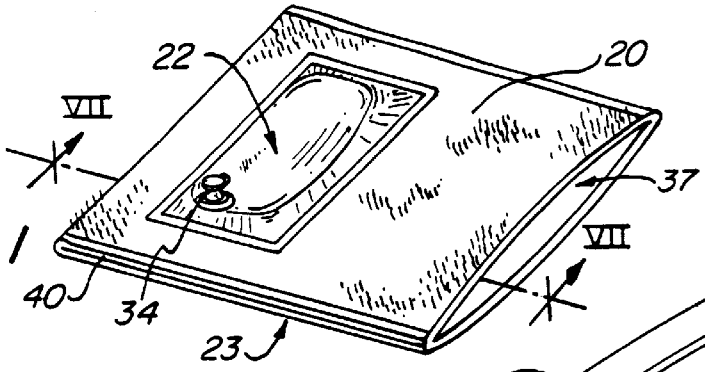
FIG. 1 is a front isometric view of a first embodiment of a slipcover with an inflatable pillow in accordance with the invention.
Figure 8:
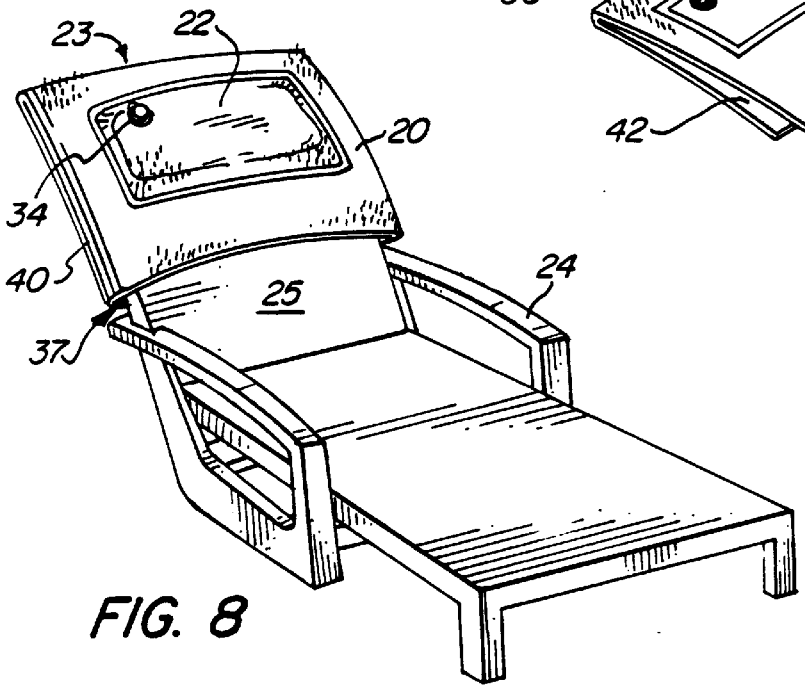
FIG. 8 is a front isometric view of the slipcover with inflatable pillow in place on an outdoor lounge chair in accordance with the invention.

With reference to FIGS. 1 and 8, a slipcover 20 is shown with an inflatable pillow 22 in accordance with the invention to hold the inflatable pillow 22 in place on furniture, such as a lounge chair 24, whether or not the chair is in use. Slipcover 20 is a pocket 23 that enables slipcover 20 to be slipped over the back 25 of chair 24 to hold inflatable pillow 22 in place. Slipcover 20 with its inflatable pillow 22, typically may be used on outdoor furniture as illustrated in FIG. 8; it is understood, however, that a slipcover of this invention can be used on other types of furniture such as on the back of a chair in an airplane, office or car.

Figure 2:
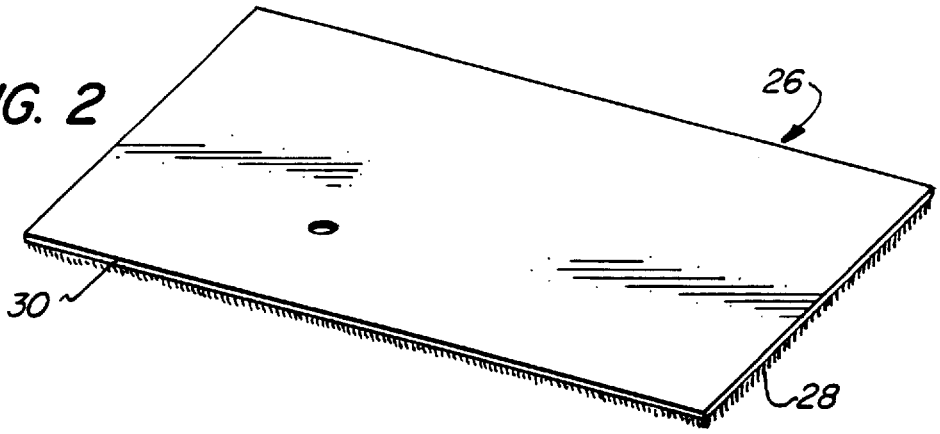
FIG. 2 is a front isometric view of a first sheet, with an inner layer of thermoplastic material facing up, used to form the slipcover with inflatable pillow in accordance with the invention.
Figure 3:
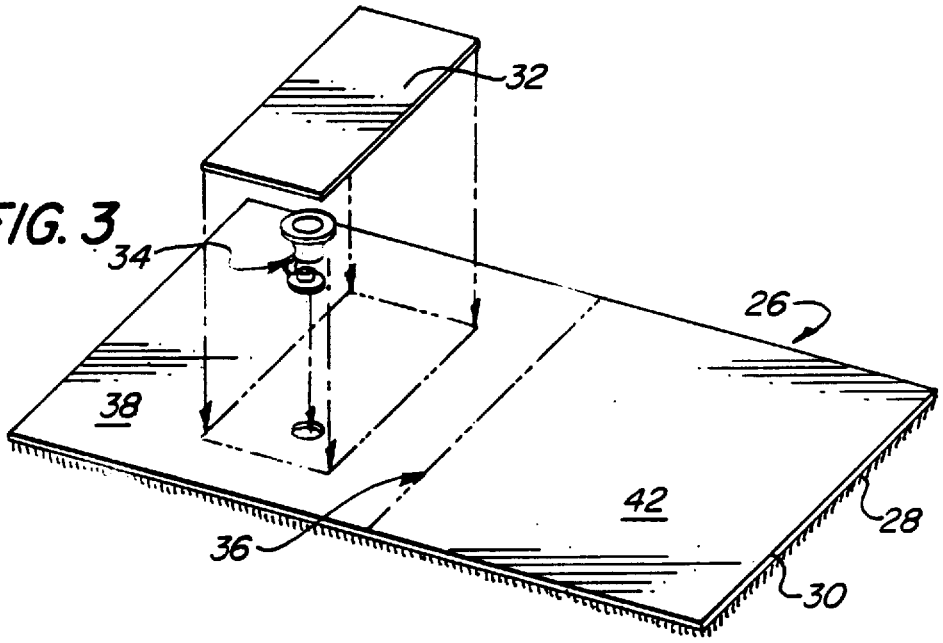
FIG. 3 is an exploded front isometric view of the different components of the slipcover with inflatable pillow to illustrate the spatial relationship between the components prior to forming the slipcover.
Figure 4:
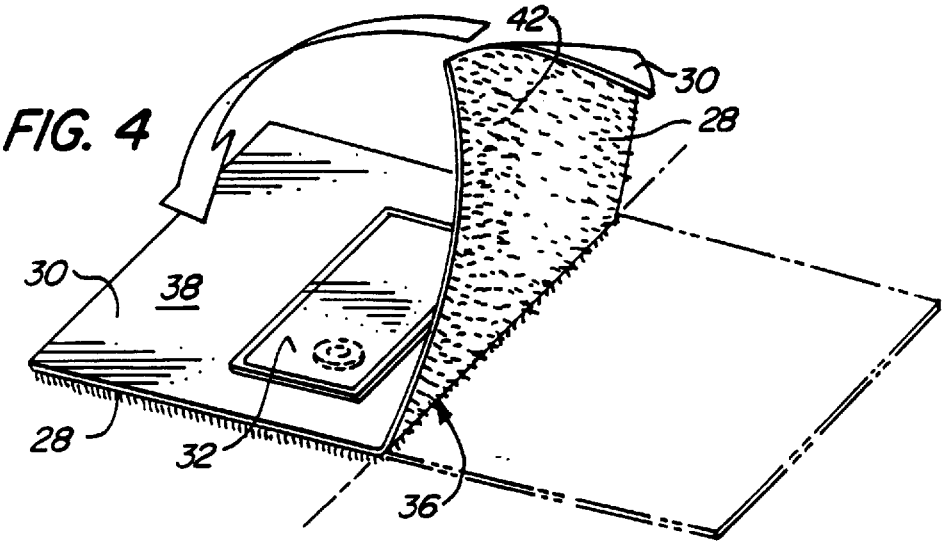
FIG. 4 is a front isometric view of a completed inflatable pillow attached to the inner layer of the first sheet to illustrate the location and direction for folding the first sheet to form the slipcover.

FIGS. 2–4 illustrate the construction of a first embodiment of a slipcover 20 in accordance with the invention. A first sheet 26 is formed and includes two layers, 28 and 30, that are attached together either along edges or otherwise adhered so as to form a laminate. Outer layer 28 is a fabric layer for the comfort of the user. The fabric can be any desired for the intended use of the slipcover 20, but is preferably a durable, soft, water-absorbing material, such as terry cloth. The fabric can be printed for decoration, for an indication of ownership, or for advertising.

Inner layer 30 is a thermoplastic layer that is suitable for forming one side of inflatable pillow 22. Although inner layer 30 can be formed from any sufficiently air impermeable material, preferably it is formed from a vinyl sheeting material, expanded vinyl, supported vinyl, neoprene compounds, polypropylene, polyethylene, polyesters, nylons, polyamides, rubber or rubber compounds. The most preferred material is vinyl sheeting as it is simple and cost effective to use in the construction of slipcover 20.

A second, smaller sheet 32 constitutes the other side of inflatable pillow 22. Second, smaller sheet 32 is formed from similar material as that used for inner layer 30. Again the preferred material is vinyl sheeting.

As illustrated in FIGS. 3 and 4, second, smaller sheet 32 is attached to inner layer 30 of first sheet 26 to form inflatable pillow 22. Any means of attaching the sheets is sufficient so long as air is not leaked when pillow 22 is inflated. Preferably second, smaller sheet 32 is sealed or welded to inner layer 30 using radio frequency sealing (RF sealing), sonic sealing, heat sealing, gluing or similar operations. Because RF sealing is fast and cost effective, it is the preferred means of attaching the two sheets when the materials are compatible with the RF sealing operation.

In either first sheet 26 or second, smaller sheet 32, a valve 34 is located to enable the inflation of inflatable pillow 22 when formed. Although all of the figures illustrate the placement of valve 34 in first sheet 26, at a position which enables the inflation of inflatable pillow 22, it is not necessary to locate valve 34 on first sheet 26. So long as first sheet 26 is of sufficient flexibility that a valve 34 located in second, smaller sheet 32, inside slipcover 20, can be reached to inflate pillow 22, valve 34 can be located in second, smaller sheet 32 to insure maximum comfort when slipcover 20 is in use. Valve 34 preferably is made of a material that is compatible with the materials of sheets 26 and 32, and is properly placed for comfort. Preferably valve 34 will either be a positive sealing valve or a stem valve as illustrated in my prior patents (U.S. Pat. Nos. 5,079,778 and 5,251,337).

The method for forming slipcover 20 is dependent on the size of first sheet 26 and the placement of second, smaller sheet 32 in relation to first sheet 26. Typically, inflatable pillow 22 is attached to first sheet 26 off center such that when first sheet 26 is folded along fold 36, a backing layer 42 is formed from the portion of first sheet 26 opposite inflatable pillow 22.

Figure 7:
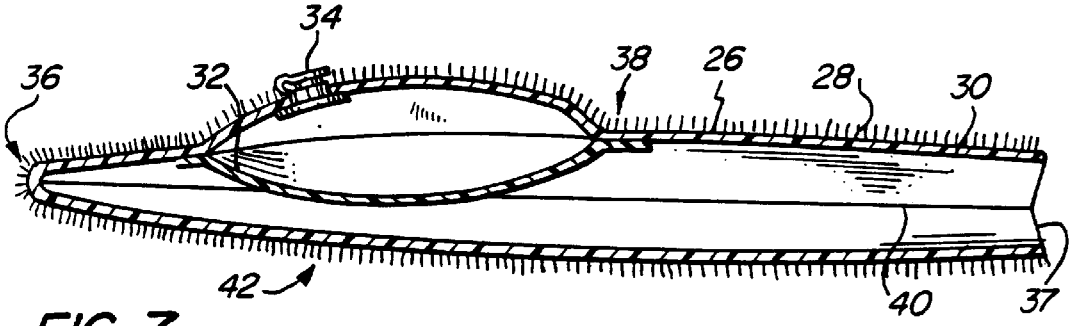
FIG. 7 is a cross-sectional view of the slipcover with inflatable pillow, taken along line VII—VII in FIG. 1, to illustrate the positioning of the inflatable pillow on the slipcover and the different layers of materials from which the first sheet is formed.

When first sheet 26 is folded along fold 36, inner layer 30 of first sheet 26 overlaps itself to completely encase inflatable pillow 22, see FIG. 4. FIG. 7 illustrates the location of the different components of slipcover 20 with respect to each other after folding first sheet 26 along fold 36. Opposed edges 40 of first sheet 26 are attached so as to form pocket 23 of slipcover 20 with its inflatable pillow 22 which has at least one opening 37 in slipcover 20 to enable the slipping of slipcover 20 over chair 24 to envelope the back 25 of chair 24, as illustrated in FIG. 1.

The method used to attach the opposed edges 40 of first sheet 26 should be sufficient to create a slipcover which can withstand the type of use slipcover 20 with its inflatable pillow 22 is intended to endure. The edges can be sewn, RF sealed, sonic sealed, heat sealed, glued, or the like, depending on the materials chosen to form first sheet 26. Preferably, when inner layer 30 is formed from vinyl, RF sealing or sonic sealing is employed.

Figure 5:
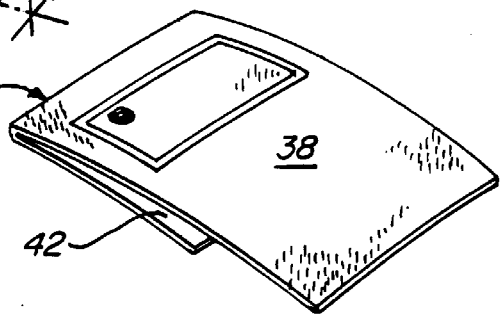
FIG. 5 is a front isometric view of an alternative configuration of the slipcover with inflatable pillow of FIG. 1.

First sheet 26 is either folded to exactly bisect its longitudinal axis so that the edges of first sheet 26 at opening 37 meet (FIG. 1) or offset so that the edges of first sheet 26 at opening 37 are askew (FIG. 5).

As depicted in FIG. 8, slipcover 20 with its inflatable pillow 22 can now be slipped over a back 25 of a chair 24 and will hold inflatable pillow 22 in place whether or not in use.

Figure 6:
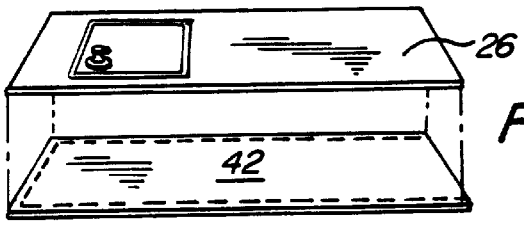
FIG. 6 is a side isometric view of an alternative method for forming the slipcover with inflatable pillow of FIG. 1.

An alternative method for forming slipcover 20 described in the first embodiment is illustrated in FIG. 6. In this method, instead of folding first sheet 26 a backing layer 42 is attached to inner layer 30 of first sheet 26 so as to create pocket 23 of slipcover 20. As illustrated in FIG. 6, first sheet 26, with attached inflatable pillow 22, is placed in register with a separate backing layer 42. Opposed edges 40 are attached to form pocket 23 of slipcover 20. The same methods taught above to attach opposed edges 40 of first sheet 26 to form slipcover 20 above, can also be employed here for attaching backing layer 42 to first sheet 26. Backing layer 42 can be formed from any material which is compatible with the desired use of slipcover 20. For example, backing layer 42 can be formed from any type of fabric, a thermoplastic material like those used to form inner layer 30, or a laminate thereof. Preferably, both backing layer 42 and inner layer 30 are formed from vinyl sheeting and are RF sealed or sonic sealed at opposing edges 40 to form pocket 23.

Figure 13:
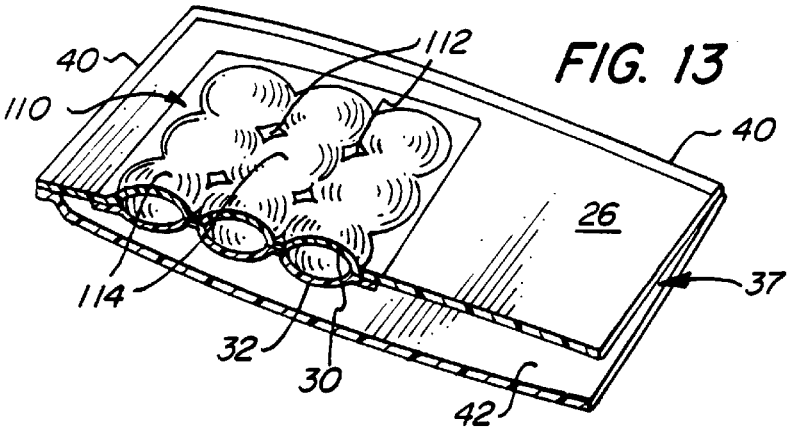
FIG. 13 is a front isometric partially broken away view of an alternative configuration of the inflatable pillow of FIGS. 1, 4–8, and 10–12 to illustrate the interconnected chambers created in the inflatable pillow.

A second embodiment for slipcover 20 is illustrated in FIG. 13. This second embodiment incorporates the use of an entirely fabric slipcover 20 and an inflatable pillow 22 which is constructed from two separate thermoplastic pieces. First sheet 100 is formed from fabric. Although any fabric can be used depending on the intended use of the slipcover 20, preferably a soft, water-absorbing material will be employed which could contain polyester, cotton or a blend thereof. Most preferably fabric sheet 100 will be formed from terry cloth made from polyester, cotton or a blend thereof. If, however, a more economical or disposable slipcover 20 is desired, fabric sheet 100 could be formed from, for example, a spunbonded polyolefin or olefin material such as Tyvek™ (a Dupont material).

A valve 102 is placed in a first piece of thermoplastic material 104. Valve 102 can be any type compatible with the materials, but is preferably either a positive sealing valve or a stem valve. A second piece of thermoplastic material 106, sized similar to first piece of thermoplastic material 104, is placed in register with first piece of thermoplastic material 104. Formation of inflatable pillow 22 can happen using two optional methods. In a first method, illustrated in FIG. 10, first piece of thermoplastic material 104 and second piece of thermoplastic material 106 are attached to construct inflatable pillow 22 separate from fabric sheet 100. After constructing inflatable pillow 22, it is attached to fabric sheet 100 using RF sealing, sonic sealing, heat sealing, sewing, gluing, adhering, or the like.

FIG. 9 illustrates a second method, in which fabric sheet 100 is placed in register with second piece of thermoplastic material 106 in register with first piece of thermoplastic material 104, and all three pieces are attached in a single operation. The means used to attach the different pieces can be any which will form an air tight inflatable pillow 22 that is sufficiently attached to fabric sheet 100 for its intended use. The pieces can be attached by RF sealing, sonic sealing, heat sealing, gluing or any combination thereof. If fabric sheet 100 is made from cotton material, the preferred method is RF sealing. If fabric sheet 100 is made from polyester or a blend thereof, preferably either RF sealing or sonic sealing is used.

Processing fabric sheet 100 into slipcover 20 is substantially the same as that described above in the first embodiment for forming a slipcover having a two-layered first sheet 26. Either fabric sheet 100 can be folded or a backing layer 42 can be employed to create opposing edges 40 which are attached by sewing, RF sealing, sonic sealing, heat sealing, gluing, adhering, or any combination thereof. If RF or sonic sealing are employed, a strip 108 of vinyl sheeting is placed between opposing edges 40, or around so as to encase opposing edges 40, of fabric sheet 100 to provide a means for adhering those edges. If fabric sheet 100 is formed from Tyvek™, a strip 108 of adhesive could be employed either between or around the opposing edges to form pocket 23.

An alternative configuration of inflatable pillow 22 is illustrated in FIG. 13. In FIG. 13, inner layer 30, or first piece of thermoplastic material 104, is attached to second, smaller sheet 32, or second piece of thermoplastic material 106, at several locations to create a quilted effect of interconnected chambers 110. Quilted effect of interconnected chambers 110 can be accomplished using any means which creates portions 112 where inner layer 30 is attached to second, smaller sheet 32 while ensuring that all detached portions 114 of inflatable pillow 22 are interconnected so that air entering valve 34 can reach all detached portions 114. For example, inner layer 30 can be RF, sonic, or heat sealed to second, smaller sheet 32 at all locations which are intended to create attached portions 112, thus forming interconnected chambers 110.

Additionally, the inventive slipcover 20 with inflatable pillow 22 is not limited to the use of a single inflatable pillow where both the slip cover and inflatable pillow have the shapes illustrated in the accompanying drawings. Multiple inflatable pillows 22 may be affixed to slipcover 20 for a desired use or design. Likewise, the shape of slip cover 20 and inflatable pillow 22 may be any which is desired for the intended use (e.g. a lumbar support, decorative headrest) but which continues to operate in such a manner that inflatable pillow(s) 22 are held at the desired location on the furniture by slipcover 20.

Figure 15:
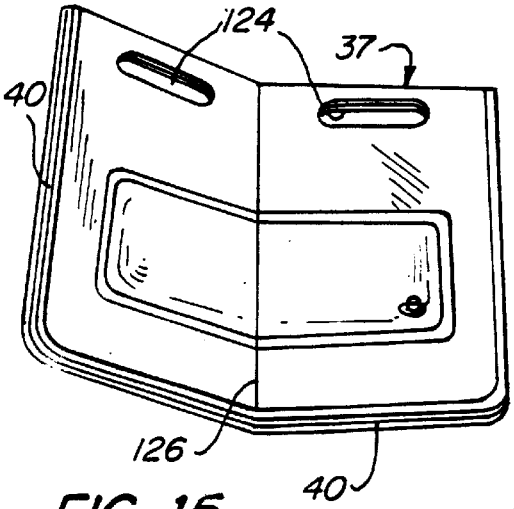
FIG. 15 is a front elevation view of the tote in FIG. 14 opened to allow its use as a slipcover with inflatable pillow.
Figure 14:
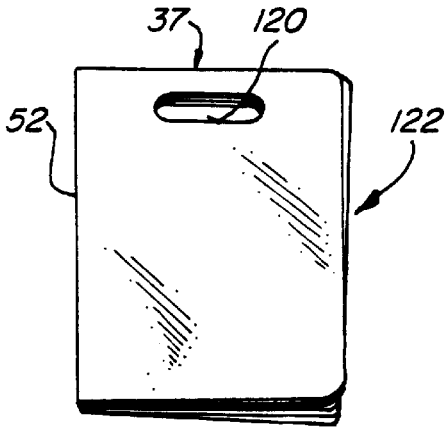
FIG. 14 is a front elevation view of an optional addition to the slipcovers in accordance with this invention to create a tote.
Figure 16:
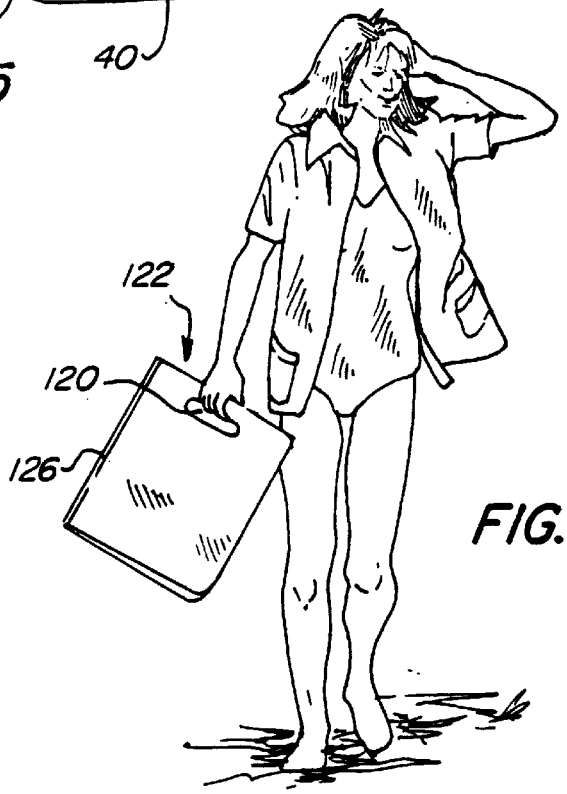
FIG. 16 is a front elevation view of the tote of FIG. 14 in use.

An optional addition to slipcover 20 with its inflatable pillow 22 is a handle 120 which converts slipcover 20 with a deflated inflatable pillow 22 into a tote 122. FIGS. 15 and 16 illustrate the removal of four oblong holes 124 near opening 37 of slipcover 20, aligned so that when slipcover 20 with its inflatable pillow 22 is folded along a line 126 which bisects inflatable pillow 22 (FIG. 15), a single handle 120 is formed, FIG. 14. Therefore, when folded into tote 122, articles can be stored in both sections of the interior of slipcover 20 and carried as illustrated in FIG. 16.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A slipcover for furniture comprising:

(a) a first sheet having an outer layer of fabric attached to an inner layer of thermoplastic material;

(b) a second, smaller sheet attached to the inner layer of the first sheet so as to form an inflatable pillow;

(c) a valve located in at least one of the sheets so as to enable the pillow to be inflated; and (d) a backing layer attached to the first sheet so as to create a pocket-shaped slipcover with the inflatable pillow in an interior of the slipcover whereby the slipcover can receive a portion of the furniture.

2. The slipcover of claim 1, wherein the outer layer is adhered to the inner layer to form a laminate.

3. The slipcover of claim 1, wherein the thermoplastic material is vinyl.

4. The slipcover of claim 3, wherein the fabric is terry cloth.

5. The slipcover of claim 1, wherein the backing layer comprises an extension of the first sheet which is folded so that the inner layer overlaps itself and is attached at opposing edges so as to create the pocket-shaped slipcover.

6. The slipcover of claim 5, wherein the opposing edges of the overlapping inner layer are sealed together using radio frequency sealing methods.

7. The slipcover of claim 1, wherein the backing layer is a separate sheet in register with the first sheet and adjacent to the inner layer, and which is attached at opposing edges to create the pocket-shaped slipcover.

8. The slipcover of claim 7, wherein the backing layer is formed of a material selected from the group consisting of thermoplastic material, fabric, and a laminate thereof.

9. The slipcover of claim 7, wherein the backing layer is a thermoplastic vinyl sheet that is radio frequency sealed to the inner layer to create the pocket-shaped slipcover.

10. The slipcover of claim 1, further comprising two holes in the first sheet and two holes in the backing layer, sized and positioned so that when the slipcover is folded to bisect the pillow, all four holes align to create a handle.

11. The slipcover of claim 1, wherein the inner layer is radio frequency sealed to the second, smaller sheet to form the inflatable pillow.

12. The slipcover of claim 1, wherein the inner layer of the first sheet is sealed in a pattern of interconnected chambers to the second, smaller sheet so as to create a quilted effect when inflated.

13. A slipcover for furniture comprising:

(a) a first sheet having an outer layer of terry cloth laminated to an inner layer of vinyl;

(b) a second, smaller sheet of vinyl sealed to the inner layer of the first sheet so as to form an inflatable pillow;

(c) a valve located in at least one of the sheets so as to enable the pillow to be inflated; and (d) a backing layer formed by folding the first sheet so that the inner layer overlaps itself and is sealed at opposing edges so as to create a pocket-shaped slipcover with the inflatable pillow in an interior of the slipcover whereby the slipcover can receive a portion of the furniture.

14. A slipcover for furniture comprising:

(a) a folded first sheet of an outer layer of terry cloth fabric laminated to an inner layer of vinyl, thereby having two portions;

(b) a second, smaller sheet of vinyl sealed to the inner layer of one of the portions of the folded first sheet so as to form an inflatable pillow;

(c) a valve located in the pillow portion of first sheet so as to enable the pillow to be inflated; and wherein opposing edges of the inner layer of vinyl are attached so as to create a pocket-shaped slipcover with the inflatable pillow in an interior of the slipcover whereby the slipcover can receive a portion of the furniture.

* * * * *